United States Patent [19]

Katoh et al.

[11] 4,156,440

[45] May 29, 1979

[54] RAILROAD TRACK BED USING INJECTION MATERIALS AND METHOD THEREFOR

[75] Inventors: Yasuo Katoh; Hideo Kakegawa, both of Tokyo; Shigeyuki Hayashi, Kawasaki; Tadakazu Yamashita, Yokohama, all of Japan

[73] Assignees: Japanese National Railways; Nippon Oil Company Ltd., both of Tokyo, Japan

[21] Appl. No.: 800,027

[22] Filed: May 24, 1977

Related U.S. Application Data

[62] Division of Ser. No. 708,117, Jul. 23, 1976.

[51] Int. Cl.[2] ..... E01B 1/00

[52] U.S. Cl. ..... 238/2; 106/273 R; 404/75

[58] Field of Search ..... 238/2, 6, 7, 9; 104/10, 104/11; 404/75, 82; 260/28.5 AS; 106/279

[56] References Cited

U.S. PATENT DOCUMENTS

| | | | |
|---|---|---|---|
| 676,129 | 6/1901 | Goldie | 104/11 |
| 3,577,250 | 5/1971 | Rostler | 260/28.5 AS X |
| 3,656,690 | 4/1972 | Hanig | 238/2 |
| 3,703,393 | 11/1972 | Koons | 260/28.5 AS X |
| 3,859,238 | 1/1975 | Kremser et al. | 260/28.5 AS |
| 3,869,417 | 3/1975 | Ramsay | 260/28.5 AS |
| 3,878,987 | 4/1975 | Uzuka | 238/2 |
| 4,028,293 | 6/1977 | van den Berg | 260/28.5 AS |

FOREIGN PATENT DOCUMENTS

| | | | |
|---|---|---|---|
| 2249677 | 4/1974 | Fed. Rep. of Germany | 238/2 |
| 2305536 | 8/1974 | Fed. Rep. of Germany | 104/11 |

*Primary Examiner*—Randolph A. Reese

[57] ABSTRACT

In a railroad track bed, an injection layer is formed between the railroad ties and the raodbed so as to protect the latter. The injected layer is composed of an injection material injected through openings formed in the tie. The injection material has a viscosity below 30 poise at a temperature not higher than 200° C. before hardening, and when hardened it has a compressive stress at 10% strain of 0.4 to 30 kg/cm$^2$ at a compressive strain rate at 40° C. of 1.5% per minute.

7 Claims, 2 Drawing Figures

RAILROAD TRACK BED USING INJECTION MATERIALS AND METHOD THEREFOR

This is a division of application Ser. No. 708,117 filed July 23, 1976.

BACKGROUND OF THE INVENTION

This invention relates to injection materials for a railroad track bed in which an injected layer is formed between the railroad tie and the roadbed.

In recent years, the increase in the volume of railroad transportation has been giving rise to a correspondingly sharp increase in the frequency of railroad stock usage, resulting in an increased frequency of maintenance work for the track, in particular, the roadbed. The greater the frequency of train passage, the shorter the time allowable for the maintenance work, and so it has become necessary to provide beds which can contribute in labor-saving in connection with roadbed and track maintenance work. To this end, there have been studies of various systems which are believed capable of replacing the conventional ballast roadbed; for example, one proposal is the provision of a concrete roadbed another the use of an integral formation in a ballast roadbed. However, labor saving of maintenance work has not yet been fully attained.

SUMMARY OF THE INVENTION

It is an object of the invention to provide a railroad track bed for which the cycle of maintenance work is prolonged.

Another object of the invention is to provide an injection material which is easily injected onto the roadbed and has a good working property.

A further object of the invention is to provide an injection material which is hard to the extent that it does not undergo a great deformation against compressive stresses and which is soft to the extent that it absorbs vibration.

According to a feature of the present invention, there is provided a track bed having an injected layer between the roadbed and the ties mounted thereon. The injected layer serves to uniformly disperse various stresses caused by the passage of a train so as to mitigate the impact force against the roadbed and protect the latter, whereby the cycle of maintenance work can be prolonged.

According to an embodiment of the present invention, the injection material used with the track bed in which a layer of the injection material is formed between the tie and the roadbed preferably has a viscosity below 30 poise at a temperature not higher than 200° C. before hardening, and when hardened it preferably has a compressive stress at 10% strain of 0.4 to 30 kg/cm$^2$ at a compressive strain rate at 40° C. of 1.5% per minute.

Other objects, features and advantages of the invention will appear more fully from the following description and from the accompanying drawings.

DETAILED DESCRIPTION OF THE INVENTION

Figure 1:
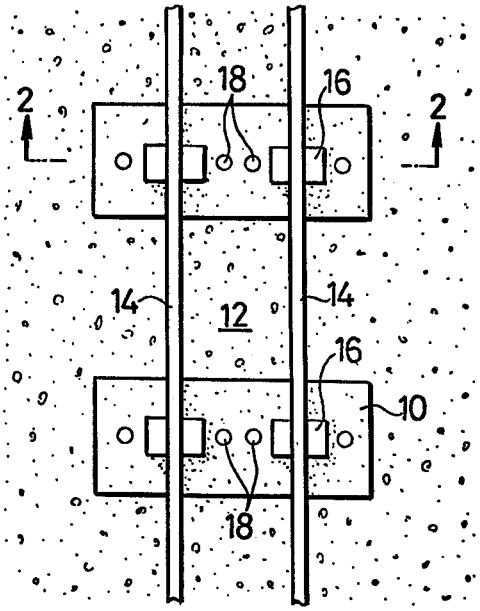
FIG. 1 is a plan view illustrating an embodiment of the track bed according to the present invention.
Figure 2:
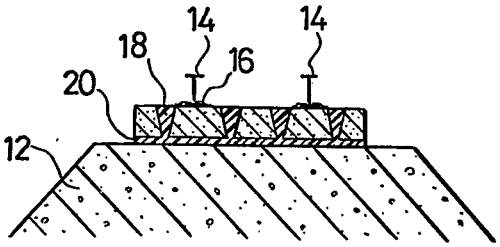
FIG. 2 is a sectional view taken on line 2—2 of FIG. 1.

We shall now describe the invention with particular reference to the accompanying drawings. Rectangular ties 10 made of concrete or other material are arranged side by side at regular intervals on a ballast roadbed 12 composed of crushed stone, etc. Rails 14 having an I-shaped section are fixed on the ties 10 by means of a clamping device 16 made of iron or the like. The clamping device 16 also acts as a washer for the rail 14. The tie 10 has openings 18 in the form of an inverted circular truncated cone, for example, the top is 8 cm in diameter and the bottom is 6 cm in diameter. Through these openings is injected a fluid injection material. The injected fluid material hardens as the time goes by to form an injected layer 20.

The injected layer 20 in such track structure serves to uniformly disperse various stresses in the roadbed lower structure 12, which stresses occur when a train passes and are transmitted through the tie 10, and at the same time it also serves to absorb as much vibration as possible which is conveyed through the tie 10 to the roadbed 12 so as to mitigate any impact force against the roadbed 12 and protect the latter, whereby it is possible to minimize the abrasion of crushed stones and prolong the cycle of maintenance work.

Injection materials for the injected layer 20 should have specific physical properties. That is, it is undesirable for them to undergo greater deformations than required throughout the year against compressive stresses conveyed through the tie 10. On the other hand, if they are too hard, it becomes impossible for them to fully absorb vibration. Further, they should be in a liquid state when injected between the tie 10 and the roadbed 12, or else injection becomes difficult. Therefore, injection materials should be liquid when injected and after having hardened they should be strong, undergo minimum deformation against compressive stress and have a good vibration absorbance.

We have numerically embodied the various requirements of a train rolling conditions and also have tested many injection materials and checked their properties. At the same time, we have carried out a vibration experiment using a track model consisting of a bed of ties 2 m wide × 0.5 m long, in which experiment an injection material was injected between the ties and the roadbed. After the injected material hardened, a 4-ton static load and a 4.5-ton vertical vibration load were simultaneously applied to the ties and a one-million vibrations test was conducted. As a result, we have found that it is possible to determine the properties required of the material and the amount of deformation of the injection material produced by the vibration experiment.

Experiments were also made with respect to the working property of the materials and to their injection requirements. As a result, it has been found that the viscosity of the injection material at the time of injection is an all important factor to determine their mode of application.

With respect to the injection property, it is preferable that the material to be injected between the tie and the roadbed be in the liquid state and that it form layers. This is advantageous not only for the working property of the material but also to alter the level of the tie as desired even if the roadbed surface is not perfectly regular.

With respect to the injection temperature, it is desirable that the injection be conducted at a temperature below 200° C. so as to prevent damage to the bed constituents because the injection material has to contact concrete products, crushed stones, etc. Further, when the efficiency of injection operation is taken into consideration, it is desirable to use injection materials with viscosities of 30 poise or lower at a temperature below 200° C. However, as set forth hereinbefore, in addition to the injection property, other properties required at time of use are still more important.

When consideration is given to the condition under which the injection material functions after it has hardened, it is necessary to consider the temperature condition for the dynamic properties of the material during operation and service. In particular, during the summer season, this temperature condition becomes important. In this connection, we have checked the temperature distribution in summer by using a track model. As a result, it became clear that the temperature under the tie may be assumed to be 40° C. at the highest. That is, the deformation resistance of the injection material when in service must be checked at a temperature of 40° C. and under this condition the material must display a satisfactory performance.

There are various forces applied through the tie onto the injection material. However, the compressive stress and shearing stress are the two main forces. What is particularly critical in the injection material is its physical property against the compressive stress. The compressive stress applied through the tie onto the injection material is attributable mainly to the impact force caused by an irregular motion which occurs due to the static load and the rolling of the train. This impact force is an overall force dependent on variations in the condition of the train and of the track and on the speed of the train. Thus it is extremely difficult to calculate exactly such impact force. For the reasons mentioned above, it would be insufficient to consider only the elastic modulus for the property of the injection material, that is, the concept of loaded speed must also be taken into account.

We have checked the properties of various materials, such as, thermoplastic materials and reaction-hardenable materials and we have also conducted the foregoing load vibration experiment thereon. As a result, it became clear that, since the physical property of the injection material is correlated to the amount of deformation of the material at the end of the load vibration experiment, the material preferably should have a compressive stress at 10% strain of 0.4–30 kg/cm$^2$ at a compressive strain rate at 40° C. of 1.5% per minute. It also became clear as a result of the experiments that if the value of the compressive stress is above 0.4 kg/cm$^2$, the injection material when in service undergoes little deformation throughout the year. For example, if the tie width is 73.3 cm and the tie spacing is 10 m, the point below the center of the tie is loaded when the train passes, generally in the following manner, as experimentally demonstrated: When using 50 kg rails, though the train speed also affects, a compressive stress starts to be applied when the wheel weight is about 2.5 to 3.0 m before the load point in question, and when the wheels reach just above the load point in question the point undergoes the maximum compressive stress, which is then gradually decreased.

When the injection material is a visco-elastic body, the conditions are complex and unlike the case with an elastic body. The resistance to deformation under a compressive force is influenced by its loaded speed, it being weak at low loading speeds. For safety sake, therefore, the condition of a low loading speed has been adopted here. That is, if the maximum deformation is 10% when the train rolls at the very low speed of about 25 m/hr, a strain speed of 1.5%/min is appropriate.

On the other hand, from the standpoint of protection of the roadbed, excessive compressive stress values are not desirable because of vibration absorbance, it being desirable that the value of compressive stress be below 30 kg/cm$^2$.

Thermoplastic materials and reaction-hardenable materials may be used as the injection material according to the present invention only if they satisfy the foregoing properties. As the thermoplastic material may be mentioned, for example, petroleum, natural or synthetic waxes and bituminous substances such as asphalts, pitches and tars, thermoplastic resins such as polyethylene, polypropylene, polystyrene, polyvinyl acetate, thermoplastic polyester, acrylic resins, polyvinyl chloride, polyacrylonitrile, diene plastics, ethylene-vinyl acetate copolymer resin, petroleum resin, cumarone-indene resin, rosin, polybutene, ethylene-propylene copolymer resin, terpene resin, thermoplastic epoxy resin, thermoplastic urethane resin, thermoplastic rubber, and sulfur.

On the other hand, a reaction-hardenable material means the combination of reactive materials such as epoxy, urethane, polybutadiene and unsaturated fatty acid systems with curing agents for hardening the said reactive materials. Also, cement compositions may be used if various rubbers or resins in emulsified state are added thereto. The above-mentioned materials may be used either alone or in combination. In addition, additives such as fibers, fillers, oils, and rubbers may be added.

EXAMPLE 16 tons of 10/20 blown asphalt and 4 tons of a low molecular weight polyethylene (with an average molecular weight of about 700) were completely melted and mixed together. The mixture had a viscosity below 5 poise at 200° C. and a compressive stress at 10% strain of 0.62 kg/cm$^2$ at a compressive strain rate at 40° C. of 1.5%/min. This material was used as the injection material in the Kansai Main Line in March 1974, and the range of use covered a section of track 75 m. It was injected at 180° C. to form an injected layer about 2 cm thick between concrete ties 73.3 cm wide arranged side by side at an interval of 10 m and a ballast roadbed (with No. 6 crushed stones of 12 mm dia dispersed and rolled after rolling of the ballast roadbed), and then it was allowed to cool and harden. When a check was made in October 1975 (two summer seasons had passed since), there was observed no deformation of the injected layers.

What is claimed is:

1. A method of providing a protective layer between railroad ties and a railroad track bed, which comprises the steps of:

(a) injecting through openings suitably provided in the ties of said bed an injection material selected from thermoplastic injection materials and reaction-hardenable injection materials and having a viscosity below 30 poise at a temperature not higher than 200° C. before hardening and having after hardening a compressive stress at 10% strain of 0.4–30 Kg/cm$^2$ at a compression strain rate at 40° C. of 1.5% per minute, said injecting being effected at a temperature below 200° C.;

(b) allowing said injection material to extend through and to fill substantially completely said openings in said ties; and (c) allowing said injection material to solidify into a single layer between said bed and the lower surface of said ties.

2. The method according to claim 1, wherein said injecting is effected with injection material in the liquid state.

3. The method according to claim 1, wherein said injecting is effected with injection materials selected from the group consisting of asphalt, pitch, tar, polyethylene, polypropylene, polystyrene, polyvinylacetate, thermoplastic polyester, acrylic resins, polyvinyl chloride, polyacrylonitrile, diene plastics, ethylene-vinyl acetate copolymers, petroleum resins, curnarone-indene resins, rosin, polybutene, ethylene-propylene copolymers, terpenes, thermoplastic epoxy resins, thermoplastic urethanes, thermoplastic rubber and sulphur.

4. The method according to claim 1, wherein said injecting is effected with injection material selected from the group consisting of the combination of epoxy resins with a hardening curing agent; urethanes with a hardening curing agent, polybutadienes with a hardening curing agent, and unsaturated fatty acid systems with a hardening curing agent.

5. The method according to claim 4, wherein additives selected from the group consisting of fibers, fillers, oils and rubbers are added to said injection material.

6. The method according to claim 1, wherein the injection material is formed by the steps of:

melting and admixing 80 weight % of blown asphalt having a penetration number of 10–20 and 20 weight % of a low molecular weight polyethylene having an average molecular weight of about 700, said resulting admixture having a viscosity of less than 5 poise at 200° C. at about 180° C.

7. A railroad track structure comprising a ballast roadbed having a relatively flat surface; a plurality of substantially rectangular ties arranged on said roadbed and supporting I-shaped rails; apertures within and through said ties for injecting an injection material; means on said ties to rigidly attach said rails thereto; and a layer of said injection material between said tie and said ballast roadbed, said injection material having a viscosity below 30 poise at a temperature not higher than 200° C. before hardening and having after hardening a compressive stress at 10% strain of 0.4–30 Kg/cm$^2$ at a compressive strain rate at 40° C. of 1.5% per minute said injection material being selected from thermoplastic injection materials and reaction-hardenable injection materials.

* * * * *